US010087041B1

(12) United States Patent
Langdon

(10) Patent No.: US 10,087,041 B1
(45) Date of Patent: Oct. 2, 2018

(54) GARDEN HOSE REEL ASSEMBLY HAVING A MOBILE BALLAST

(71) Applicant: Dess Langdon, Angier, NC (US)

(72) Inventor: Dess Langdon, Angier, NC (US)

( * ) Notice: Subject to any disclaimer, the term of this patent is extended or adjusted under 35 U.S.C. 154(b) by 0 days.

(21) Appl. No.: 15/652,384

(22) Filed: Jul. 18, 2017

(51) Int. Cl.
*B65H 75/40* (2006.01)
*B65H 75/44* (2006.01)
*B65H 75/42* (2006.01)

(52) U.S. Cl.
CPC ..... *B65H 75/4471* (2013.01); *B65H 75/403* (2013.01); *B65H 75/42* (2013.01); *B65H 75/4478* (2013.01); *B65H 75/4492* (2013.01); *B65H 2701/33* (2013.01); *Y10T 137/6958* (2015.04)

(58) Field of Classification Search
CPC ..... B65H 75/40; B65H 75/403; B65H 75/42; B65H 75/4478; B65H 2701/33; B65H 2701/331; B65H 75/4471; B65H 75/4492; Y10T 137/6918–137/6962
USPC ..... 137/355.16–355.28
See application file for complete search history.

(56) References Cited

U.S. PATENT DOCUMENTS 3,556,455 A * 1/1971 Storm ..... A61G 13/107 137/355.16
4,732,345 A * 3/1988 Golden ..... B65H 49/32 137/355.27
6,338,360 B2 * 1/2002 Spear ..... B65H 75/403 137/355.12
6,807,982 B1 * 10/2004 Ames ..... B65H 75/364 137/355.27
7,377,289 B1 * 5/2008 English ..... B65H 75/4407 137/355.2
7,857,000 B1 12/2010 Langdon
2006/0102231 A1 * 5/2006 Schiller ..... B62B 3/10 137/355.12
2007/0212233 A1 * 9/2007 Chang ..... B65H 75/403 417/234
2010/0294372 A1 * 11/2010 Granger ..... B65H 75/403 137/1
2012/0227835 A1 * 9/2012 Korus ..... B65H 75/36 137/355.27

* cited by examiner

*Primary Examiner* — Michael R Reid
*Assistant Examiner* — Jonathan Waddy
(74) *Attorney, Agent, or Firm* — Coats & Bennett, PLLC

(57) ABSTRACT

A mobile water hose reel assembly is provided and includes a mobile ballast, a support post extending upwardly from the mobile ballast and a housing supported by the support post and including an interior hose reel. Supply water is directed into a lower portion of the post and into a water supply pipe therein. From the water supply pipe, the water is routed to the housing and into an inlet end of a hose disposed around a hose reel in the housing.

8 Claims, 7 Drawing Sheets

GARDEN HOSE REEL ASSEMBLY HAVING A MOBILE BALLAST

FIELD OF THE INVENTION

The present invention relates to garden hose reels and more particularly to garden hose reels that are mobile.

BACKGROUND

The Applicant is the inventor of the garden water hose assembly shown in U.S. Pat. No. 7,857,000 (the '000 patent). After considerable research and development relating to the garden water hose assembly shown in the '000 patent, the Applicant has endeavored to make substantial improvements to the garden water hose assembly shown in the '000 patent. For example, the garden water hose assembly shown in the '000 patent is stationary and indeed is generally permanently mounted in the ground such that it cannot easily be moved from one location to another.

The aim of the present application is to contribute significant improvements to water hose reels of the prior art and to make manufacturing sophisticated hose reels easier and more cost effective.

SUMMARY OF THE INVENTION

The present invention entails a garden hose assembly that includes a mobile ballast that serves two functions. First, the mobile ballast provides a stable support structure for the garden hose assembly when in use. Secondly, since the ballast is mobile, it can easily be moved from location-to-location.

Another aspect of the present invention relates to a more efficient means of conducting water through a support structure and into a housing that includes a hose reel and which permits the housing to rotate with respect to the support structure. In one embodiment, the support structure includes an upright post and a water supply line extending upwardly through the post. There is also provided a water line disposed in the housing and operatively connected to a hose wound around a reel in the housing. The water line includes an outlet that comprises a stub plastic pipe that includes a pair of axially spaced O-rings extending around the circumference thereof. The plastic stub pipe is inserted into a plastic washer seated in an upper terminal end of the water supply pipe. The insertion of the plastic stub pipe having the O-rings into the plastic washer forms a water tight seal and at the same time enables the plastic stub pipe and the O-rings secured thereto to rotate within the fixed plastic washer secured to the upper end of the water supply pipe. This design provides a water tight seal but at the same time enables the water line, as well as the housing, to rotate about the axis of the post.

Other objects and advantages of the present invention will become apparent and obvious from a study of the following description and the accompanying drawings which are merely illustrative of such invention.

DESCRIPTION OF THE EXEMPLARY EMBODIMENTS

Figure 1:
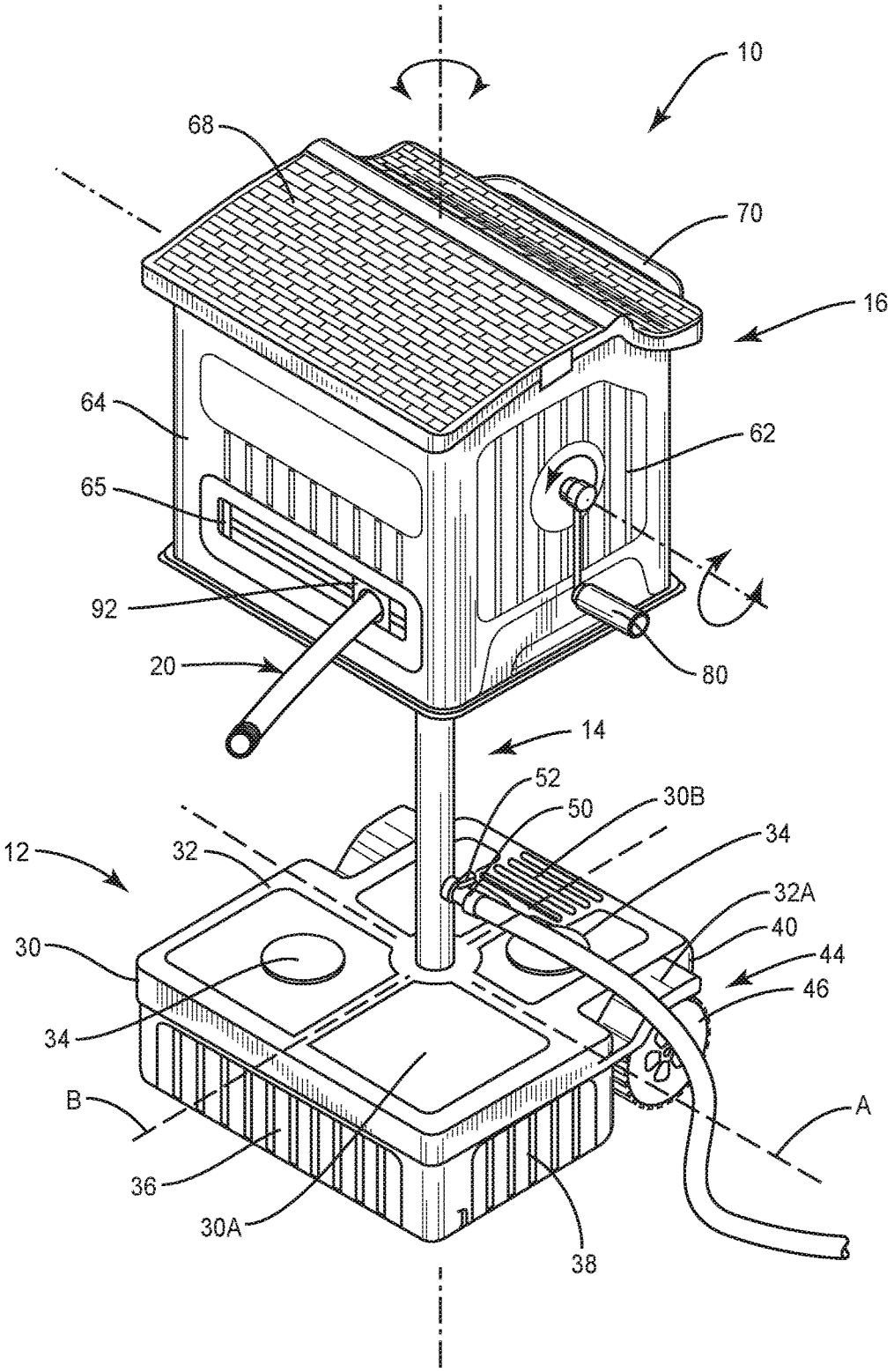
FIG. 1 is a perspective view of the garden hose reel assembly of the present invention.
Figure 2:
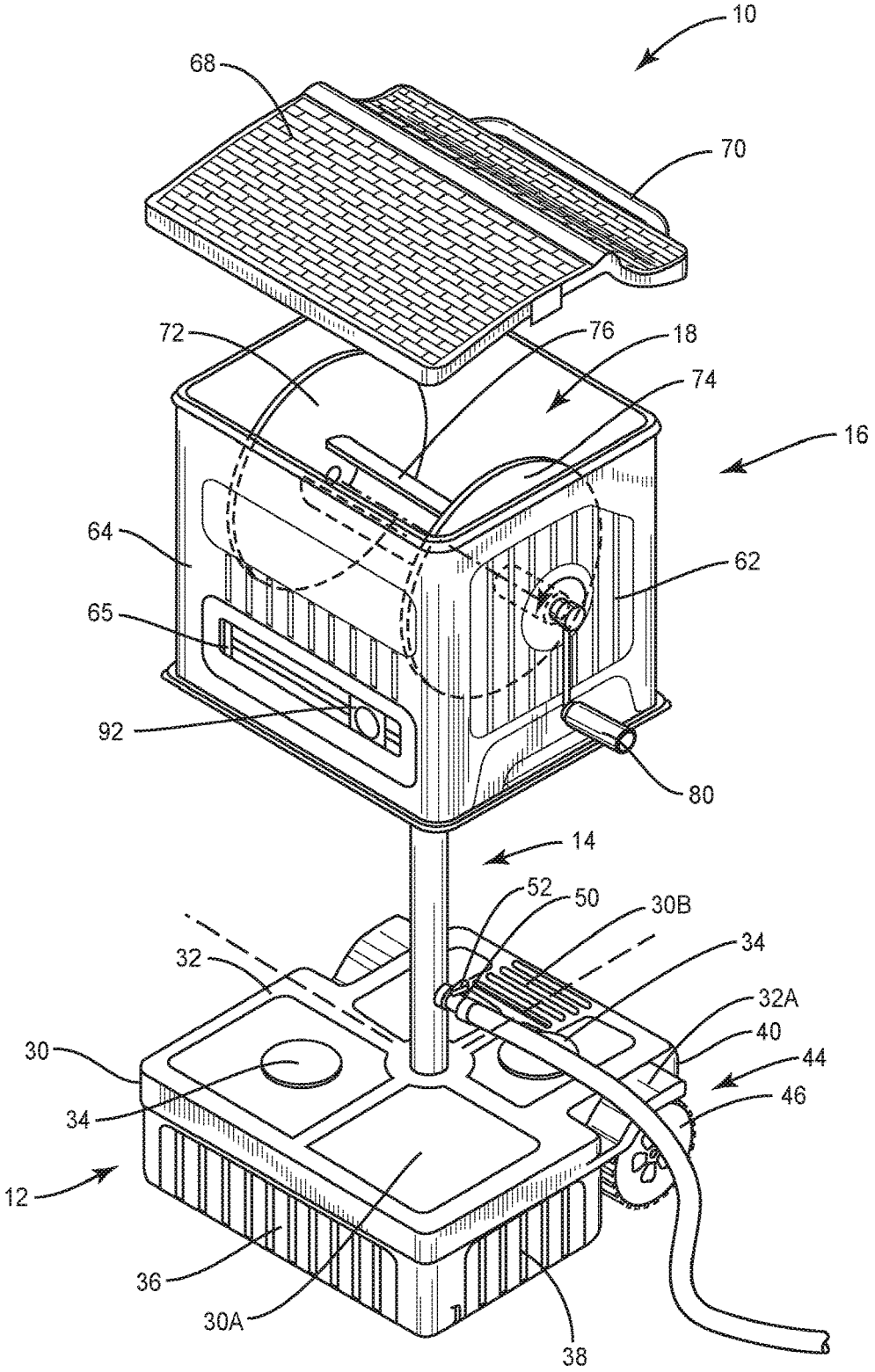
FIG. 2 is a view similar to FIG. 1 but wherein the top of a housing is removed to better illustrate the internal structure and components within the housing.
Figure 5:
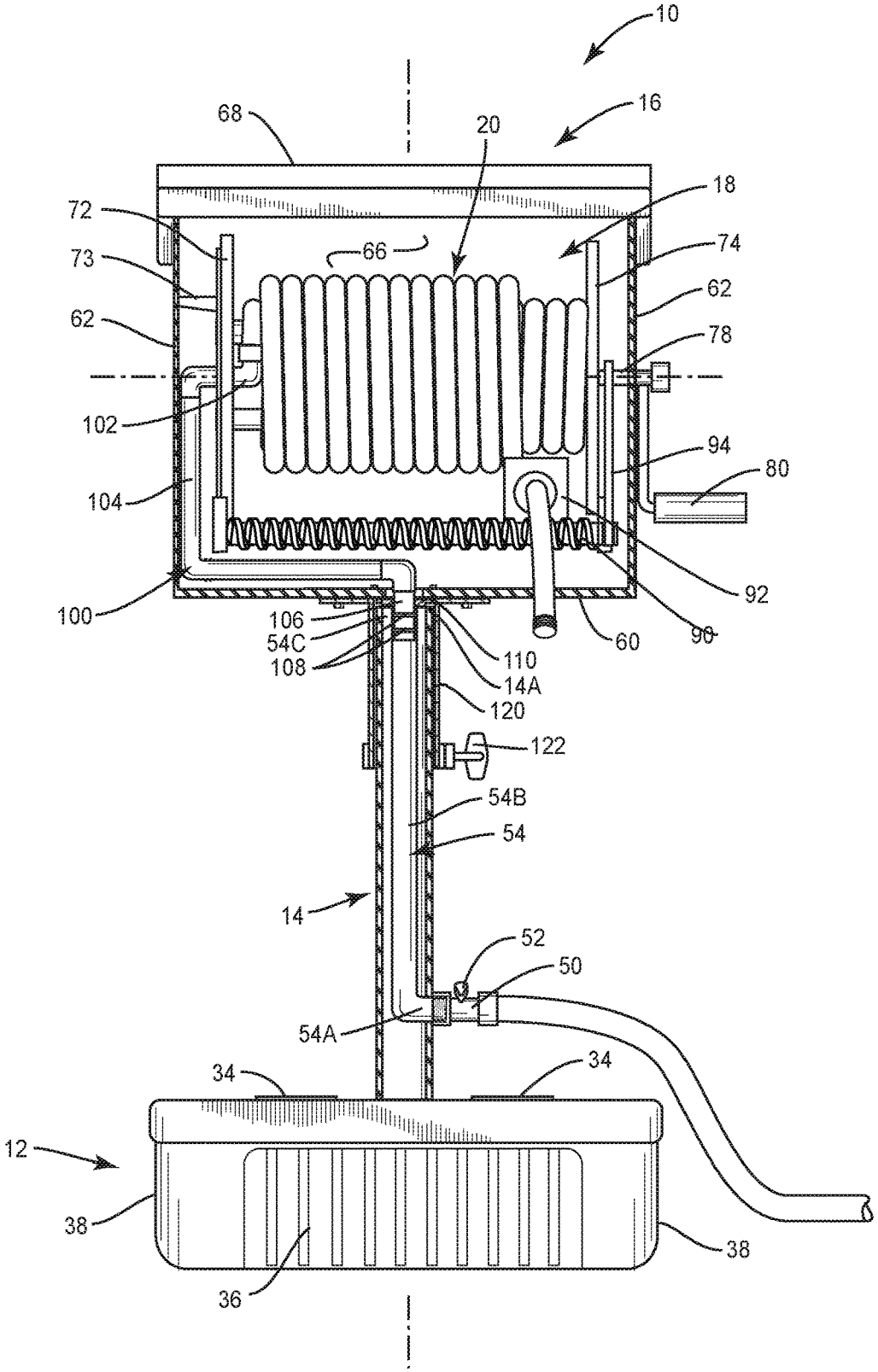
FIG. 5 is a sectional view similar to that shown in FIG. 4 but showing a hose wound around the hose reel within the housing.

With further reference to the drawings, particularly FIG. 1, the garden hose reel assembly of the present invention is shown therein and indicated generally by the numeral 10. Before discussing the garden hose reel assembly 10 in detail, it is beneficial to briefly review the basic assembly. First, there is provided mobile ballast indicated generally by the numeral 12. Ballast 12 provides a strong and sturdy support for assembly 10 when it is being used. In addition, the ballast 12 is mobile. Extending upwardly from the mobile ballast 12 is a support post 14. The support post 14 supports a housing 16. Disposed in the housing, as shown in FIG. 2, is a hose reel indicated generally by the numeral 18. Hose reel 18 supports a wound hose 20. See FIG. 5. Hose 20 can be unwound from the hose reel 18 and extended out the front of the housing 16 for use.

Now turning to the components of the garden hose reel assembly 10, focus will first be on mobile ballast 12. Mobile ballast 12 includes a ballast tank 30 which can be constructed of molded plastic, metal, wood or other suitable materials. Ballast tank 30 includes a reservoir for holding ballast material such as gravel. Formed about the top of the ballast tank 30 is a top platform 32. Top platform 32 includes one or more openings 34 for permitting materials such as gravel to be poured or delivered into the ballast tank 30.

Figure 6:
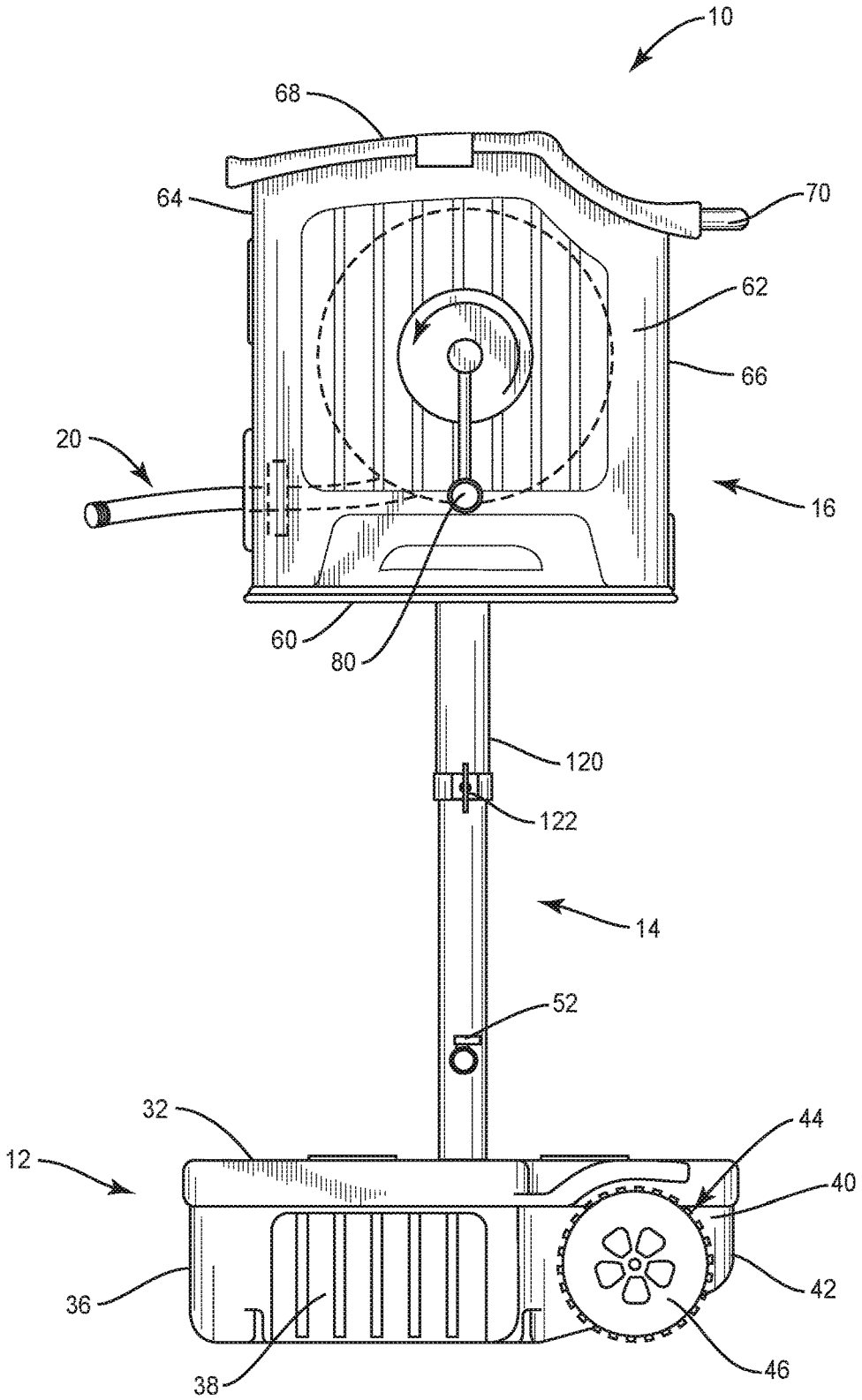
FIG. 6 is a side elevational view of the garden hose reel assembly of the present invention.

Ballast tank 30 includes two sections, referred to as a front section or first section 30A and a rear section or second section 30B. In FIG. 1, there is shown a transverse reference line A and a longitudinal reference line B. Transverse reference line A in this embodiment can be viewed as generally being a dividing line between the first section 30A and the second section 30B. As seen in FIG. 1, the first section 30A includes a front panel 36 and a pair of sides 38. As seen in FIG. 6, the second section 30B includes a pair of sides 40 and a rear panel 42. Note that the second section 30B projects rearwardly from the first section 30A. Also, as seen in FIG. 1, the first section 30A, compared to the second section 30B, is relatively wide while the second section 30B, compared to the first section 30A, is relatively narrow. As such, the sides 40 of the second section 30B are indented with respect to the sides 38 of the first section 30A. About the outboard of the sides 40 of the second section 30B there is formed wheel spaces indicated generally by the numeral 44. These wheel spaces enable wheels 46 to be rotatively mounted adjacent the sides 40 of the second section 30B. Note that the top platform 32 includes wheel covers 32A that extend over the wheels 46. See FIGS. 1 and 2, for example.

Extending upwardly from the mobile ballast 12 is the support post 14. Support post 14 is generally centrally located with respect to the mobile ballast 12. As seen in FIG. 1, the support post in this embodiment lies at the intersection of the two reference lines A and B. In any event, it is desirable for the support post 14 to extend generally through or close to the center of gravity of the mobile ballast 12. This assures that the housing 16 supported by the post 14 is balanced and stable when the mobile ballast 12 assumes the horizontal support position shown in FIGS. 1 and 2.

Figure 4:
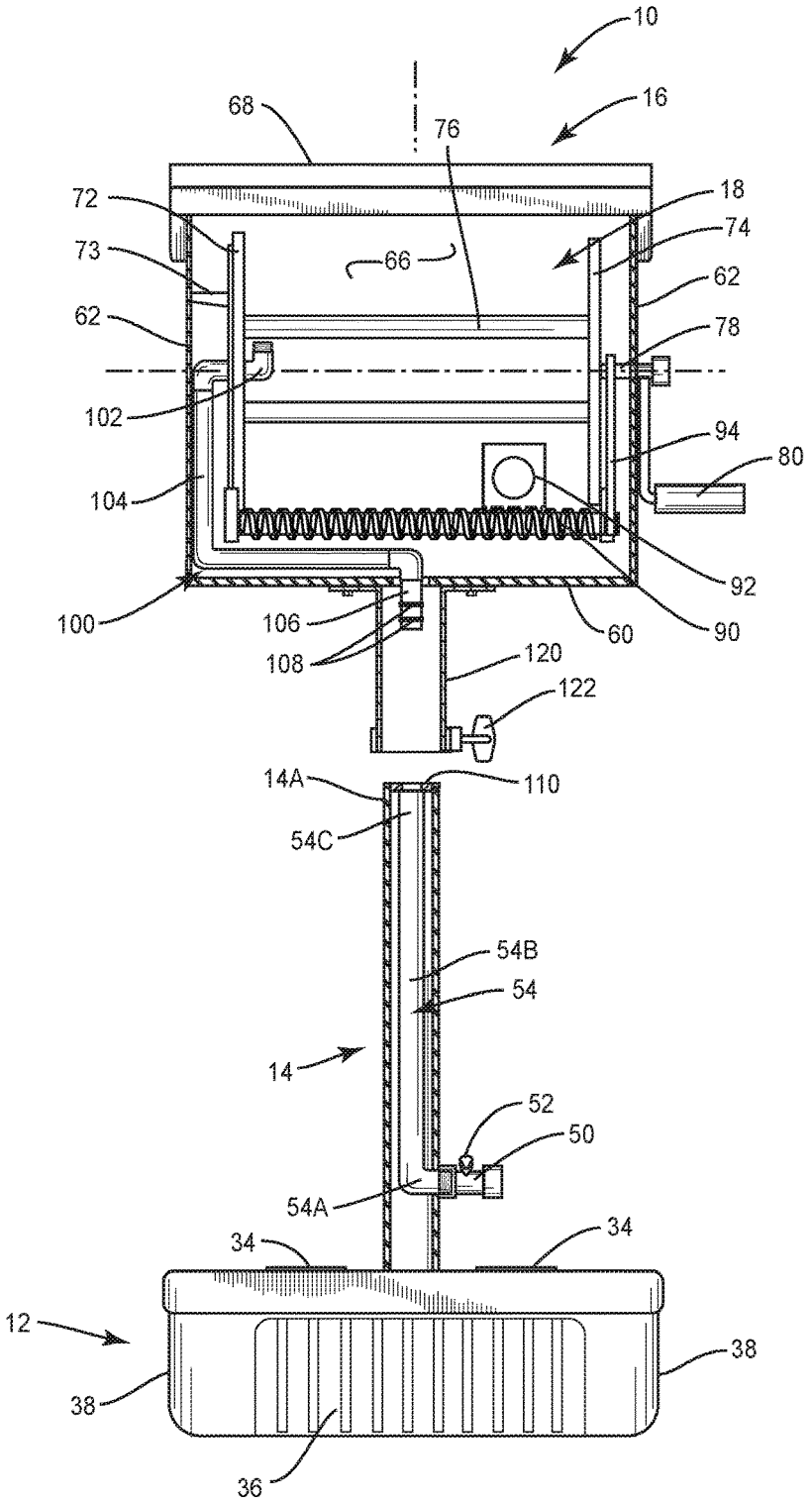
FIG. 4 is a front sectional view of unassembled portions of the garden hose reel assembly of the present invention.
Figure 4A:
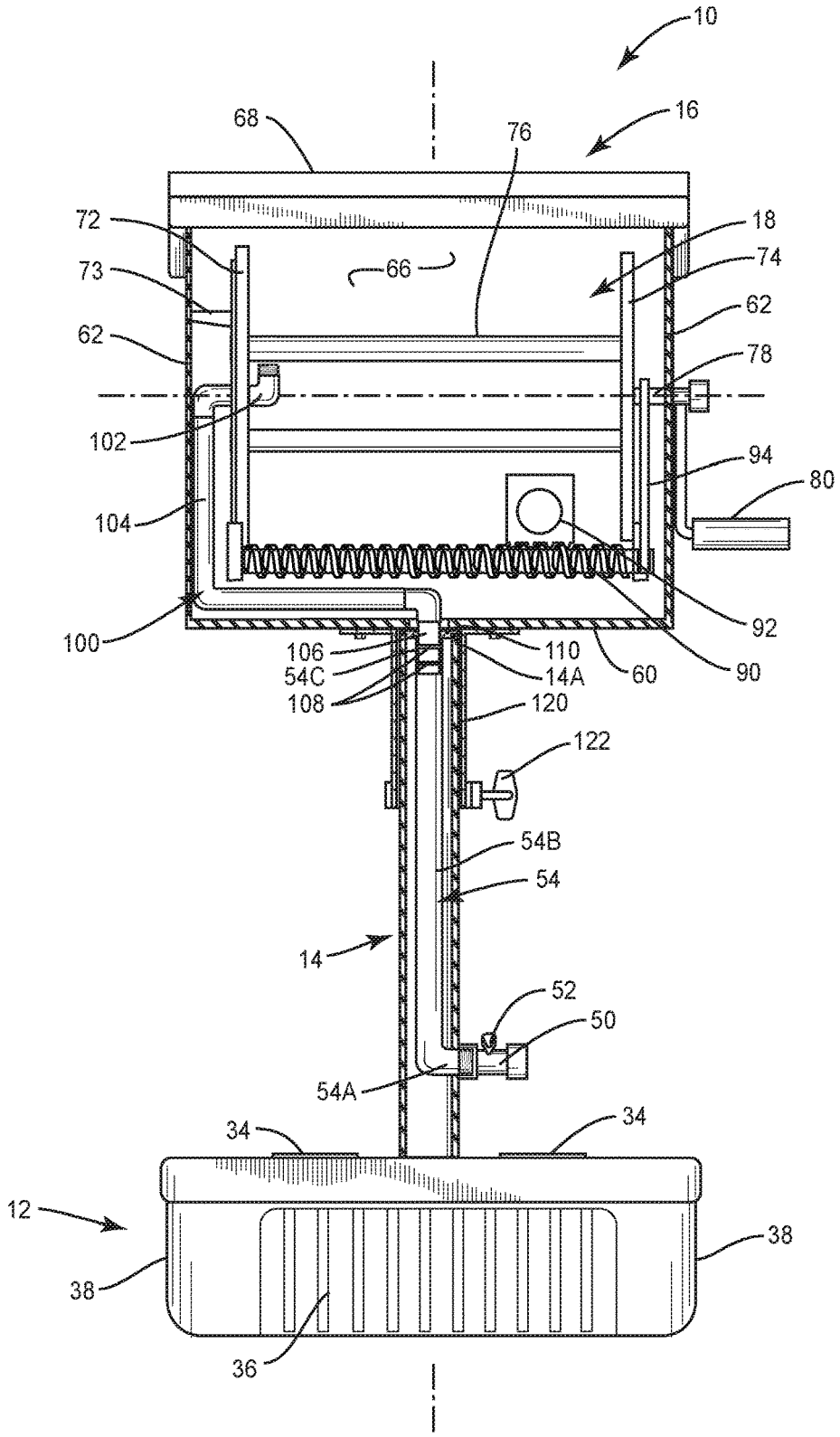
FIG. 4A is a front sectional view similar to FIG. 4 but showing the garden hose reel assembly assembled.

As seen in FIG. 4, the post includes an upper terminal end 14A. At a lower portion on the support post 14 there is provided a water inlet 50. See FIG. 4, for example. The water inlet 50 includes an on/off valve 52.

Supported on post 14 is a housing 16. Housing 16 includes a bottom and a pair of side walls 62. Housing 16 also includes a front 64, a back 66 and an openable top 68. There is also provided an elongated transverse slot 65 formed in the front 64 which enables the hose 20 to be fed from the interior of the housing. A handle 70 is attached to the back edge of the top 68 and extends therefrom. Note that the handle 70 overlies the wheels 46. This facilitates the clockwise tilting of the ballast 12 and the housing 16 about the axis of the wheels 46, as viewed in FIG. 6. Once tilted, it follows that the entire garden hose reel assembly can be easily moved from one location to another location.

In the embodiment illustrated herein, there is provided a sleeve 120 that is attached to the bottom 60 of the housing 16. This is illustrated, for example, in FIG. 4. Note that the inside diameter of sleeve 120 is slightly greater than the outside diameter of support post 14. This enables the sleeve 120 to be slipped downwardly over the outside of the post 14. Furthermore, the arrangement of the sleeve 120 and the post 14 is configured such that the sleeve 120, as well as the housing 16, can rotate about the central axis of the post 14.

Inside the housing 16, there is rotatively mounted a hose reel indicated generally by the numeral 18. Hose reel 18 receives the hose 20 and the hose is wound around the hose reel. See FIG. 5. Viewing the hose reel 18 in more detail, note that the hose reel includes a pair of end walls 72, 74. See FIG. 2, for example. The leftmost end wall 72 is rotatively supported on frame structure 73. See FIG. 4. Extending between the end walls 72 and 74 is a series of four slats 76 on which the hose 20 is wound. Extending outwardly from the rightmost end wall 74 is a drive shaft 78 that is rotatively journaled in the right side wall 62 of the housing. Connected to the drive shaft 78 is a crank 80 that is employed for rotatively driving the hose reel 18.

Adjacent the inside of front panel 64 is a transverse worm gear 90. See FIG. 4. Worm gear 90 is rotatively mounted in the housing 16 between the front wall or panel 64 and the hose reel 18. Worm gear 90 is driven by a belt 94 that is trained around the drive shaft 78 and extends downwardly therefrom to an end of the worm gear 90 where the belt is drivenly connected to the worm gear. Thus, by rotating the crank 80, belt 94 is driven which in turn rotates the worm gear 90. Operatively associated with the worm gear 90 is a transverse travelling feeder 92. As the worm gear 90 is driven, the feeder 92 oscillates back and forth adjacent the slot 65 formed in the front panel 64 of the housing 16. Once the travelling feeder 92 reaches a left or right extreme position, as shown in FIG. 4, the reverse threads on the worm gear 90 enable the traveling feeder 92 to automatically reverse directions and travel back in the opposite direction. Hose 20 wound around the reel 18 extends from the reel through an opening in the traveling feeder 92 and out the slot 65 as shown in FIG. 1.

As shown in the drawings, water is delivered to a lower portion of the post 14, directed upwardly through the post into the housing where the water is routed to an inlet end of the hose 20 wound around the reel 18. Viewing this in more detail, there is provided a water supply line, indicated generally by the numeral 54, disposed in the post 14. See FIG. 4, for example. Water supply line 54 includes an elbow 54A that is operatively connected to the inlet 50 formed in the post 14. A main section 54B extends from the elbow 54A upwardly towards the terminal end 14A of the post. Water supply line 54 includes an upper terminal end 54C.

Continuing to refer to FIG. 4, there is a water line, indicated generally by the numeral 100, disposed in the housing 16. Water line 100 functions to receive water being directed through the water supply line 54 in the post 14 and to direct that water into the housing and more particularly into the inlet end of the hose 20 wound around the reel 18. Viewing water line 100 in detail, note that it includes a section 102 that is configured to connect to the inlet end of the water hose 20. Extending from section 102 is an L-shaped section 104. L-shaped section 104 leads to a plastic pipe stub 106. Note that the plastic pipe stub 106 forms a part of an elbow and is turned downwardly inside the sleeve 120. That is, the plastic pipe stub 106 is generally aligned with the central axis of the sleeve 120. Disposed about the outer circumference of the terminal end portion of the pipe stub 106 is a pair of O-rings 108.

Figure 3:
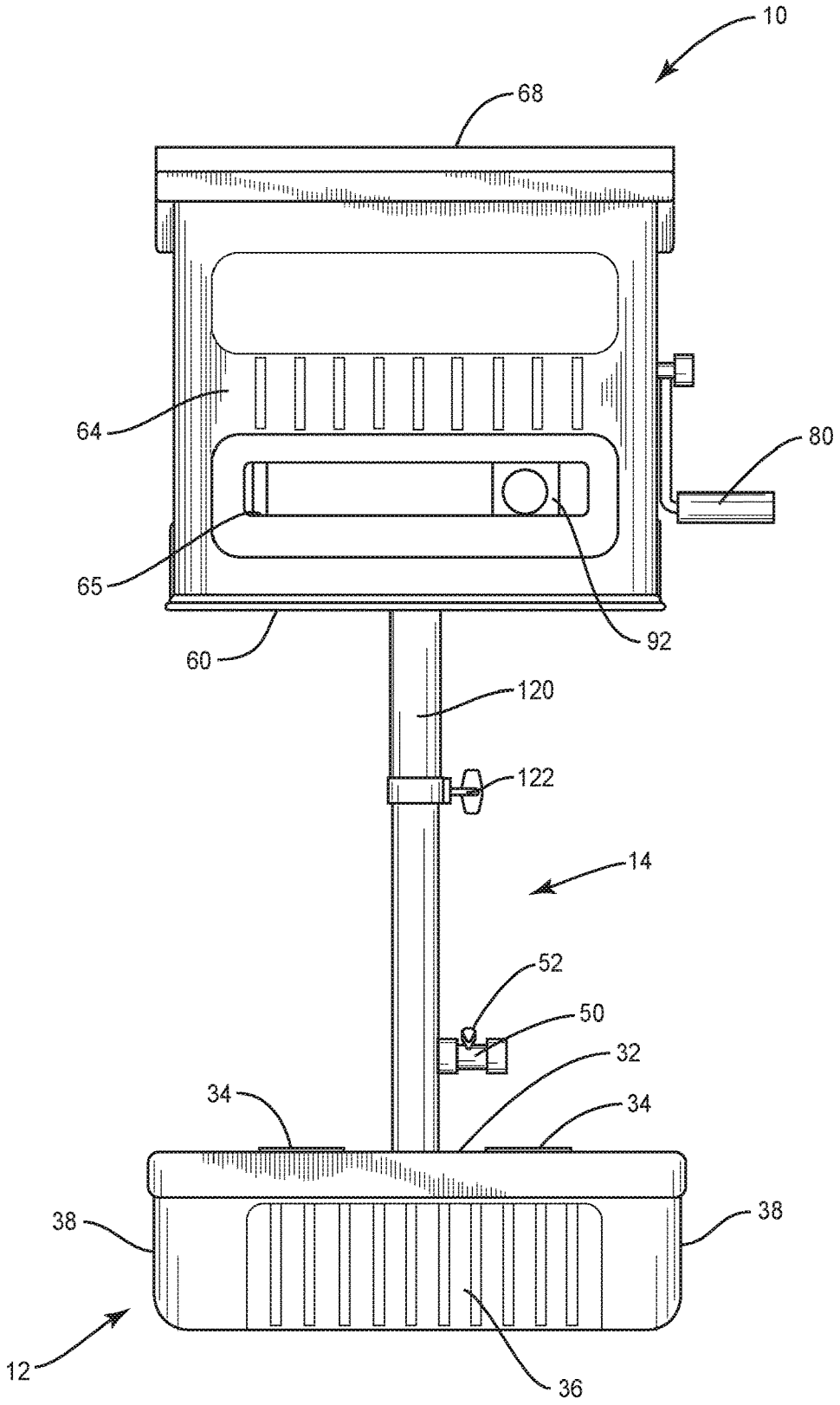
FIG. 3 is a front elevational view of the garden hose reel assembly.

Secured to the upper terminal end 54C of the water supply pipe is a stationary plastic washer 110. Plastic washer 110 is designed to receive and mate with the plastic pipe stub 106 in order to create a water tight seal and at the same time to permit the plastic pipe stub 106 to rotate within the plastic washer 110. Thus, the outside diameter of the plastic pipe stub 106, including the O-rings 108, is slightly less than the inside diameter of the plastic washer 110. However, these diameters are close and sufficiently close such that the O-rings 108 create and form a water tight seal against the interior surface of the water supply pipe 54 just below the washer 110. Note that the washer 110 is seated in the water supply pipe 54. Washer 110 is supported by an annular flange that projects outwardly onto the upper terminal end of the water supply pipe 54. The main body of the washer 110 includes a through opening and, as shown in FIG. 4, the main body of the washer 110 projects at least slightly down into the water supply pipe 54. The top surface of the washer 110 is configured to be a bearing surface. When the housing and sleeve 120 are fitted downwardly onto the post 14 as viewed in FIG. 3, the upper bearing surface of the washer 110 engages the bottom 60 of the housing 16. This upper bearing surface enables the housing 16 to rotate on it as the housing is rotated about the central axis of the post 14.

Thus, as viewed in FIG. 4, the housing 16 and sleeve 120 are lowered onto the post 14. Sleeve 120 is aligned with the post 14 such that the post 14 is inserted into the interior of the sleeve. As the sleeve 120 and housing are lowered, the plastic pipe stub 106 will align with the stationary plastic washer 110 and the continuing lowering of the sleeve 120 and the housing 16 will cause the plastic pipe stub to be inserted through the interior of the stationary plastic washer. As discussed above, when appropriately installed, the upper bearing surface of the plastic washer 110 engages the bottom 60 of the housing. This facilitates the rotation of the housing 16 about an axis of the post 14. At the same time, the pipe stub 106 extends through the plastic washer 110 and with the aid of the two O-rings 108 that engage the inner surface of the water supply pipe 54, a water tight seal is formed between the water supply pipe and the water line 100. Now supply water can be fed via the inlet 50 into the supply pipe 54 and from there into and through the plastic pipe stub 106 and ultimately to section 102 of the water line 100, which delivers the water to the inlet of the hose 20 wound around the reel 18.

In some cases, it is desirable to prevent the housing 16 and sleeve 120 from rotating about post 14. To prevent such rotation, there is provided an adjustable clamp 122 secured around a lower portion of sleeve 120. See FIG. 4, for example. By clamping the sleeve 120 tightly to the post 14, this will prevent the housing 16 from rotating about the post 14. This may be desirable when moving the garden hose reel assembly 10 from one location to another.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A mobile garden hose assembly comprises:

a ballast tank configured to hold ballast and including a top platform having one or more openings configured to enable ballast to be inserted into the ballast tank;

the ballast tank including a first section that is relatively wide and which includes a pair of opposed sides, and a second section that is relatively narrow and which projects from the first section and includes outboard sides that are indented relative to the sides of the first section;

a pair of wheels transversely aligned with the second section of the ballast tank and longitudinally spaced from said first section;

each wheel being disposed in a wheel space defined adjacent the outboard sides of the second section of the ballast tank;

an elongated post secured to the ballast tank such that said first section lies on one side of the post and said second section lies on an opposite side of said post;

a water inlet formed in the post;

a vertical water supply pipe disposed in the post and operatively connected to the water inlet and extending upwardly therefrom through the post and including an upper terminal end;

a housing having a bottom, side walls, an openable top and an interior area;

a hose reel rotatively mounted in the interior of said housing;

a water hose wound around said hose reel and including an inlet end;

a sleeve mounted to the bottom of the housing and extending downwardly therefrom and wherein the sleeve is configured to extend downwardly over a top portion of the post;

wherein the post is configured to support the housing and permits the housing and sleeve to rotate about an axis of the post;

a water line operatively connected to the inlet end of the water hose and extending therefrom through the housing;

the water line including an inlet end that is operatively coupled to the water supply pipe in said post such that water entering the water inlet formed in the post moves upwardly through the water supply pipe into the water line and from there to and through the water hose in the housing; and a clamp secured around the sleeve and configured to compress the sleeve against the post and prevent the sleeve and housing from rotating about the axis of the post.

2. The mobile garden hose assembly of claim 1 further including:

a worm gear rotatively mounted adjacent the hose reel;

wherein the hose reel includes a drive shaft; and a belt drive trained around said drive shaft and extending therefrom and drivingly interconnected with the worm gear such that rotation of the drive shaft causes the worm gear to rotate.

3. The mobile garden hose assembly of claim 1 including a stationary plastic washer supported on the upper terminal end of the water supply pipe and wherein the stationary plastic washer include an upper bearing surface that engages the bottom of said housing and wherein as the housing rotates the bottom of said housing engages the bearing surface of the stationary plastic washer.

4. The mobile garden hose assembly of claim 3 wherein the inlet end of the water line includes a plastic pipe stub that includes a pair of axially spaced O-rings and wherein the plastic pipe stub extends through an opening in the stationary plastic washer and wherein the pair of O-rings is configured to engage an interior wall of the water supply pipe below the stationary plastic washer.

5. A mobile garden hose assembly comprising:

a ballast tank configured to hold ballast and including a top having one or more openings configured to enable ballast to be inserted into the ballast tank;

a pair of wheels rotatively mounted adjacent the ballast and configured with respect to the ballast tank to permit the ballast tank and garden hose assembly to be tilted and moved from one location to another;

an elongated post attached to the ballast tank and extending upwardly therefrom;

a water inlet formed in the post;

a vertical water supply pipe disposed in the post and operatively connected to the water inlet and extending upwardly therefrom through the post and including an upper terminal end;

a stationary plastic washer seated in the upper terminal end of the water supply pipe;

the stationary plastic washer including an opening and an angular flange disposed on the upper terminal end of the water supply pipe and wherein the angular flange includes an upper bearing surface configured to engage a rotating element;

wherein a portion of said stationary plastic washer projects downwardly into said water supply pipe;

a housing comprising a bottom, side walls, an openable top, and an interior area;

a hose reel rotatively mounted in the interior area of said housing;

a water hose wound around said hose reel and including an inlet end;

a sleeve mounted to the bottom of the housing and extending downwardly therefrom, and wherein the sleeve is configured to extend downwardly over a top portion of the post;

wherein the post is configured to support the housing and to permit the housing and sleeve to rotate about an axis of the post;

a water line operatively connected to the inlet end of the water hose and extending therefrom through the housing;

the water line including an inlet that comprises a plastic pipe stub having an outside diameter less than the diameter of said opening in said stationary plastic washer;

wherein the plastic pipe stub includes two axially spaced O-rings disposed around the circumference of the plastic pipe stub;

wherein said plastic pipe stub is seated in said stationary plastic washer and projects downwardly through the opening of said stationary plastic washer where the O-rings project outwardly and engage an interior surface of the water supply pipe below the stationary plastic washer and wherein the plastic pipe stub, O-rings, and stationary plastic washer are configured to form a water tight seal at the upper terminal end of the water supply pipe;

wherein the O-rings and plastic pipe stub rotate within the stationary plastic washer as the housing and sleeve are rotated;

wherein the upper bearing surface of said stationary plastic washer engages said bottom of said housing when said housing is rotated about the axis of said post; and a clamp mounted to the sleeve and configured to clamp said sleeve against said post and prevent said sleeve and housing from rotating about the axis of said post.

6. The mobile garden hose assembly of claim 5 wherein the top of the ballast tank includes an upper platform that extends over said pair of wheels and wherein the pair of wheels is mounted underneath a rear portion of said upper platform.

7. The mobile garden hose assembly of claim 6 including a handle projecting from a rear portion of the housing and wherein said handle and the pair of wheels are disposed on the same side of the post and wherein the handle and the pair of wheels are configured such that by pulling rearwardly and downwardly on the handle, the ballast tank and housing are tilted about an axis of the pair of wheels which facilitates the movement of the garden hose assembly from one location to another.

8. The mobile garden hose assembly of claim 5 further including:

a worm gear rotatively mounted adjacent the hose reel;

wherein the hose reel includes a drive shaft; and a belt drive trained around said drive shaft and extending therefrom and drivingly interconnected with the worm gear such that rotation of the drive shaft causes the worm gear to rotate.

* * * * *